United States Patent [19]

Wernicke et al.

[11] 4,260,474

[45] Apr. 7, 1981

[54] THERMAL CRACKING OF HEAVY FRACTION OF HYDROCARBON HYDROGENATE

[75] Inventors: Hans J. Wernicke, Wolfratshausen; Walter Kreuter, Penzberg; Claus Schliebener, Strasslach, all of Fed. Rep. of Germany

[73] Assignee: Linde Aktiengesellschaft, Wiesbaden, Fed. Rep. of Germany

[21] Appl. No.: 82,453

[22] Filed: Oct. 9, 1979

[30] Foreign Application Priority Data

Oct. 6, 1978 [DE] Fed. Rep. of Germany ..... 2843792

[51] Int. Cl.[3] ..... C10G 69/06

[52] U.S. Cl. ..... 208/57; 585/251

[58] Field of Search ..... 208/57; 585/251, 324, 585/650, 652

[56] References Cited

U.S. PATENT DOCUMENTS

| | | | |
|---|---|---|---|
| 2,871,182 | 1/1959 | Weekman | 208/57 |
| 3,373,220 | 3/1968 | Hepp | 585/324 |
| 3,781,195 | 12/1973 | Davis et al. | 585/251 |
| 3,898,299 | 8/1975 | Jones | 208/57 |
| 4,167,533 | 9/1979 | Raymond | 585/251 |

*Primary Examiner*—Herbert Levine

*Attorney, Agent, or Firm*—Millen & White

[57] ABSTRACT

To obtain olefins by the thermal cracking of hydrocarbons, e.g., vacuum gas oil, by hydrogenation and subsequent steam cracking, an intermediate fractionation of the hydrogenate is provided so that the light fraction enriched in branched isomers can be used as fuel and the heavy fraction only is subjected to the steam cracking.

6 Claims, No Drawings

THERMAL CRACKING OF HEAVY FRACTION OF HYDROCARBON HYDROGENATE

BACKGROUND OF THE INVENTION

This invention relates to the production of olefins by the thermal cracking of heavy hydrocarbon mixtures wherein the starting mixture is first subjected to hydrogenation.

To produce olefins, it is conventional and advantageous to employ light hydrocarbons, such as, for example, ethane or propane, or hydrocarbon mixtures having a boiling point of below 200° C., such as, for example, naphtha, as starting materials for a thermal cracking operation. These starting materials result in a high yield in olefins and relatively few undesirable by-products.

However, in view of the high demand for olefins, which may lead to a short supply and increase in price of the aforementioned advantageous starting materials, several attempts have been made through the years to develop processes which permit the utilization of higher-boiling starting materials.

When employing such higher-boiling charges, the olefin yield is reduced and the yield of liquid hydrocarbons boiling above 200° C. is increased. The proportion of the latter high-boiling fraction, which is difficult to treat in further operation, increases significantly with the boiling point of the starting material. In addition, further difficulties are encountered in that higher-boiling starting materials lead to increased formation of coke and tar. These products are deposited on the walls of the conduit elements, for example, pipelines and heat exchangers, thereby impairing heat transfer, and furthermore resulting in constrictions in cross section. It is therefore necessary to conduct a removal of these deposits more frequently than when using light hydrocarbons.

In order to solve this problem, DOS [German Unexamined Laid-Open Application] No. 2,164,951 describes a process wherein the starting material is catalytically hydrogenated prior to the thermal cracking thereof. By virtue of this pretreatment, there is affected a reduction in the content of aromatic compounds in the starting material, otherwise leading to undesired cracked products. Moreover, a desulfuration of the starting material occurs.

In U.S. Pat. No. 3,898,299, a process is described wherein atmospheric petroleum residue feedstock is hydrogenated, then subjected to vacuum distillation to recover a distillate boiling below 650° C. at atmospheric pressure, and only this distillate is subjected to thermal cracking.

In both DOS No. 2,164,951 and U.S. Pat. No. 3,898,299, a maximum thermal cracking temperature is in the range of 700°-1000° C.

SUMMARY OF THE INVENTION

An object of this invention is to provide a process of the above type which can be operated under particularly favorable economical conditions.

Upon further study of the specification and appended claims, further objects and advantages of this invention will become apparent to those skilled in the art.

These objects are attained by a process comprising conducting the hydrogenation, separating the resultant hydrogenation product into a light fraction and a heavy fraction, and subjecting only the heavy fraction to the thermal cracking stage.

In the hydrogenation of a heavy hydrocarbon mixture, the reaction comprises not only the hydrogenation or hydrocracking of the heavy components, especially the polyaromatic compounds, but also the isomerization of n-alkanes and n-alkyl chains. As the intensity of the hydrocracking increases, the greater the degree of isomerization. Also, as the hydrocracking intensity is increased, larger quantities of hydrogen are consumed netting only a relatively minor increase in olefin yield.

By separation of the hydrogenation product into fractions of differing boiling ranges, it has been found that the degree of isomerization of the higher-boiling components of the hydrogenation product is unexpectedly low as compared with that of the lower-boiling components. Furthermore, after separating the more extensively isomerized light-boiling components, it has been uncovered that the remaining high-boiling cut leads, during thermal cracking, to surprisingly high olefin yields rivaling those of naphtha.

The process of this invention has the advantage, inter alia, that the thermal cracking step can be conducted under especially favorable conditions. While in the conventional process of DOS No. 2,164,951, as well as the process of U.S. Pat. No. 3,898,299, the hydrogenation product passed into the thermal cracking stage, has a relatively wide boiling range, the process of this invention utilizes for this purpose a substantially narrower boiling cut, whereby the cracking conditions can be better optimized.

The preferred petroleum feeds to the hydrogenation step are all distillates and deasphalted fractions boiling above 200° C. (at atmospheric pressure), e.g., gasoil, vacuum gasoil, deasphalted atmospheric or vacuum residue, visbreaker or coker distillates.

In addition to the high yield in valuable products in the thermal cracking of the high-boiling cut, the proportion of pyrolysis fuel oil, boiling above 200° C. a relatively undesirable material, is likewise surprisingly low. In all experiments with hydrogenated vacuum gas oil cuts, this proportion was below 20% by weight of the cracked products and thus below the range of a conventional cracking of atmospheric gas oil. In contrast thereto, in the thermal cracking of a vacuum gas oil which was not hydrogenated, up to 40% by weight of pyrolysis fuel oil is produced.

The cause for the high yields in the cracked product is seen in the chemical structure of the hydrogenated vacuum gas oil boiling cut comprising predominantly non-isomerized paraffins and naphthenes, both of which lead to high olefin yields. To keep the proportion of these components at a maximum in the high-boiling fraction of the hydrogenation product, it is advantageous to conduct the hydrogenation under gentle conditions. In such a case, the high-boiling naphthenes and paraffins are isomerized only to a minor degree, and primarily naphthenes are produced from the polyaromatic compounds contained in the vacuum gas oil.

The thermal cracking of the fraction which is heavier as compared to conventional cracking starting materials does not present any special technical problems. However, it is necessary to increase the vapor dilution as compared with conventional plants, e.g. to above 0.7 kg steam per kg of the hydrogenation product, usually to 0.8-1.5 kg/kg.

The separated, low-boiling components of the hydrogenation product which are not fed to the thermal cracking stage comprise gasoline fractions suitable as low-sulfur carburetable or turbine fuels or they may be blended with other refinery products. In addition thereto—insofar as these components are not left in the heavy fraction—medium distillates are obtained satisfying the requirements regarding fuel oil of the EL specification as well as diesel fuel. These fractions are especially valuable because of their low sulfur content. They can, moreover, also be blended with other sulfur-rich products to render the latter economically useful.

Of course, the quality of the hydrogenation product depends to a great degree on the reaction conditions of the hydrogenation. In this connection, it is advantageous to control the hydrogenation in such a way that the undesirable polyaromatic compounds of the starting hydrocarbon mixture are extensively hydrogenated, whereas the content of the monoaromatic compounds is hardly altered. Since the largest proportion of the monoaromatics passes over into the low-boiling fraction during the fractionation of the hydrogenation product, the properties of the hydrogenation product are improved for engine fuel uses. Moreover, in such a manner of operation, there is no unnecessary consumption of hydrogen for monoaromatic hydrogenation.

A favorable hydrogenation product results, for example, from a hydrogenation conducted under gentle conditions, i.e. at temperatures of between 350° and 400° C., under a pressure of between 80 bar and 150 bar, and at a rate per unit volume of more than 1 l. per l. of catalyst material per hour, with the use of conventional hydrogenation or hydrocracking catalysts. With the use of vacuum gas oil as the starting hydrocarbon mixture, it is even possible to maintain rates per unit volume of more than 2 l. per l. of catalyst material per hour.

A hydrogenation conducted under such conditions leads to a low hydrogen consumption, for example, in case of a vacuum gas oil hydrogenation with a conversion of 40% by weight of the hydrocarbons to low-boiling components at below 150 $Nm^3$ of hydrogen per ton of starting hydrocarbon mixture. Favorable hydrogenation conditions are generally present if the hydrogen consumption is 100–250 (in case of a conversion of 30–50% by weight to lighter products).

As seen from the above, a small portion of the paraffins and naphthenes contained in the hydrocarbon mixture is also reacted in all cases, i.e. isomerized or cracked under hydrogenation. The major proportion of these products passes over, during the separation of the hydrogenated product, into the low-boiling fraction and improves, due to isomerization, the use of this fraction for engine fuel purposes.

It has proven to be especially advantageous to absorb into the fraction with the lower-boiling components either the components boiling below 200° C. or those boiling below 340° C. If the cut is executed at 200° C., a gasoline fraction is obtained which can, in turn, be fractionated into a light gasoline fraction and a heavy gasoline fraction. The cut below 340° C. contains aditionally kerosine and fuel oil and/or diesel fuel, which fulfill ASTM-specifications.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The starting material in all cases is a vacuum gas oil having a boiling range of between 340° and 580° C., the density of which (at 15° C.) was 0.913 g./ml. This material is composed of 85.78% by weight of carbon; 12.14% by weight of hydrogen; 1.94% by weight of sulfur; and 0.14% by weight of nitrogen; 47.8% by weight of the hydrocarbons is present as paraffins and naphthenes; 19.2% by weight is present as monoaromatics; and 33.0% by weight is present as polyaromatics. The proportion of asphaltenes is below 0.05% by weight.

EXAMPLE 1

For comparison purposes, a sample of the vacuum gas oil was cracked thermally without hydrogenation. At a vapor dilution of 1 kg. of steam per kg. of vacuum gas oil and with a residence time of 0.2 second, this sample was reacted in a tubular cracking reactor. The outlet temperature was 830° C. During this thermal cracking step, a cracked product was obtained containing 9.3% by weight of methane, 18.5% by weight of ethylene, and 10.3% by weight of propylene. 33.5% by weight of the vacuum oil employed was obtained as pyrolysis fuel oil boiling at above 200° C.

EXAMPLE 2

A vacuum gas oil having the same properties as set forth in Example 1 was hydrogenated at 380° C. under a pressure of 100 bar and at a rate per unit volume of 1.2 liter per liter of catalyst material per hour. For purposes of the hydrogenation, a catalyst was employed containing, as the hydrogenation-active components, nickel and molybdenum on a weakly acidic support.

During a hydrogenation, 145 $Nm^3$ of hydrogen was reacted per ton of vacuum gas oil utilized.

A product was obtained during a hydrogenation which contained up to 59.7% by weight of components boiling at above 340° C. Moreover, 40.3% by weight of products boiling at below 340° C. was obtained; these products were separated by distillation and then further fractionated, thus obtaining (based on the entire hydrogenation product) 2.0% by weight of $H_2S$, 0.2% by weight of $NH_3$, 0.3% by weight of gaseous hydrocarbons with 1–4 carbon atoms, and 37.8% by weight of liquid hydrocarbons. The liquid products were separated into a light gasoline fraction ($C_5$-hydrocarbons up to 82° C.) which represented 0.7% by weight of the hydrogenation product, into a heavy gasoline fraction (82°–180° C.) which represented 6.4% by weight, and into a fraction of kerosine and desulfured fuel oil EL (30.7% by weight) boiling between 180° and 340° C. The essential properties of these three fractions are indicated in Table 1.

TABLE 1

| | $C_5$–82° C. | 82–180° C. | 180–340° C. |
|---|---|---|---|
| Density (15° C.) g/ml | 0.698 | 0.779 | 0.850 |
| C:H g/g | 6.03 | 6.71 | 6.80 |
| S wt. ppm | 15 | 135 | 480 |
| RON clear | 83 | 71 | |
| Ron+0.15 g Pb | 89 | 76 | |
| Cetane number | | | 54 |
| Paraffins % by wt. | 67.3 | 34.3 | 77.6 |
| Naphthenes % by wt. | 23.0 | 32.4 | |
| Aromatics % by wt. | 9.7 | 33.3 | 22.4 |
| Isoparaffins/ n-Paraffins g/g | 3.57 | 2.73 | |

The fraction boiling at above 340° C., the properties of which are indicated in Table 2, column (1), was utilized as the starting material for the thermal cracking step. The cracking conditions were the same as set forth in Example 1, resulting in a cracked product containing, as valuable components, 9.2% by weight of methane, 26.9% by weight of ethylene, and 14.4% by weight of propylene. The proportion of the residual fraction boiling at above 200° C. was 18.2% by weight.

EXAMPLE 3

The same starting material as described in Example 1 was hydrogenated under conditions somewhat more vigorous than those set forth in Example 2. A fraction boiling at above 340° C. was thus obtained, the properties of which are indicated in column (2) of Table 2.

This fraction was subjected to thermal cracking under the same conditions as indicated in the preceding examples. The cracked product contained, as the valuable components, 9.1% by weight of methane, 32.0% by weight of ethylene, and 17.0% by weight of propylene. The residual fraction boiling at above 200° C. constituted merely 7.4% by weight of the starting cracking gas material.

TABLE 2

| | | (1) | (2) |
|---|---|---|---|
| Density (15° C.) | g/ml | 0.868 | 0.833 |
| Boiling range | °C. | 340-540 | 340-480 |
| C:H | g/g | 6.42 | 5.95 |
| S | wt. ppm | 850 | 34 |
| N | " | 100 | 10 |
| Paraffins | % by wt. | 35.6 | 89.4 |
| Naphthenes | " | 36.9 | |
| Monoaromatics | " | 15.7 | 7.3 |
| Polyaromatics | " | 11.8 | 3.3 |

The preceding examples can be repeated with similar success by substituting the generically and specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the cracking of heavy liquid hydrocarbon feed mixtures having a normal boiling point over 200° C. and containing monoaromatics and polyaromatics by hydrogenation of said feed and subsequent thermal cracking of resultant feed to obtain olefins, the improvement comprising the hydrogenation step being conducted under mild conditions such that the monoaromatics are essentially unchanged and the polyaromatics are extensively hydrogenated, and wherein between the hydrogenation step and the thermal cracking stage, there is provided an intermediate step of separating the hydrogenation product into a (i) light fraction containing the major proportion of the monoaromatics and (ii) a heavy liquid fraction, said heavy liquid fraction being substantially less isomerized than said light fraction, and subjecting only said heavy liquid fraction to the thermal cracking stage to obtain a product stream rich in ethylene.

2. A process according to claim 1, wherein the hydrogenation is conducted under conditions under which between 100 and 250 $Nm^3$ of hydrogen is converted per ton of hydrocarbon.

3. A process according to claim 1, said heavy fraction contains only components boiling at above 340° C.

4. A process according to claim 1, where the heavy hydrocarbon mixture used as feed to the hydrogenation step is a vacuum gas oil.

5. A process according to claim 1, wherein the hydrogenation step is conducted at about 350°-400° C. under a pressure of about 80-150 bar and at a rate per unit volume of more than 1 liter per liter of catalyst material per hour.

6. A process according to claim 5, wherein the hydrogenation is conducted under conditions under which between 100 and 250 $Nm^3$ of hydrogen is converted per ton of hydrocarbon.

* * * * *